US009422483B2

(12) United States Patent
Tertel et al.

(10) Patent No.: US 9,422,483 B2
(45) Date of Patent: Aug. 23, 2016

(54) METHODS FOR TREATING HYDROCARBON STREAMS CONTAINING MERCAPTAN COMPOUNDS

(71) Applicant: UOP LLC, Des Plaines, IL (US)

(72) Inventors: Jonathan Andrew Tertel, Mt. Prospect, IL (US); Luigi Laricchia, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 380 days.

(21) Appl. No.: 14/066,544

(22) Filed: Oct. 29, 2013

(65) Prior Publication Data

US 2015/0114883 A1 Apr. 30, 2015

(51) Int. Cl.

| | |
|---|---|
| ***C10G 19/08*** | (2006.01) |
| ***C10G 53/16*** | (2006.01) |
| ***C10G 19/02*** | (2006.01) |

(52) U.S. Cl.

CPC ..... *C10G 19/08* (2013.01); *C10G 19/02* (2013.01); *C10G 53/16* (2013.01); *C10G 2300/104* (2013.01); *C10G 2300/202* (2013.01)

(58) Field of Classification Search

CPC ..... C10G 19/08; C10G 53/16; C10G 19/02; C10G 2300/202; C10G 2300/104

See application file for complete search history.

(56) References Cited

U.S. PATENT DOCUMENTS

| | | | |
|---|---|---|---|
| 2,570,278 | A | 10/1951 | Ryder |
| 2,693,442 | A | 11/1954 | Tom et al. |
| 4,040,947 | A | 8/1977 | Christman |
| 4,081,354 | A | 3/1978 | Christman |
| 4,207,174 | A | 6/1980 | Christman |
| 4,347,226 | A | 8/1982 | Audeh et al. |
| 4,491,565 | A | 1/1985 | Verachtert |
| 4,562,300 | A | 12/1985 | LaFoy |

(Continued)

FOREIGN PATENT DOCUMENTS

| | | | |
|---|---|---|---|
| EP | 122977 | B1 | 11/1987 |
| GB | 1337494 | A | 11/1973 |

OTHER PUBLICATIONS

Pan, et al., "Removal of Mercaptans From Light Fractions of FCC Naptha by Caustic Extraction," Petroleum Processing and Petrochemicals, v 36, N. 10, p. 24-27, Oct. 2005.

Zhu, "Causes of Extraction Alkaline Solution Failure in LPG Sweetening and Process Improvement," Petroleum Refinery Engineering, v 38, N. 10, p. 20-24, Oct. 15, 2008.

(Continued)

*Primary Examiner* — Randy Boyer
*Assistant Examiner* — Juan Valencia

(57) ABSTRACT

Disclosed is a method for treating hydrocarbon streams containing mercaptan compounds including contacting a first, relatively light hydrocarbon stream including mercaptan compounds with a first alkaline caustic solution to remove the mercaptan compounds from the first hydrocarbon stream and generate a second alkaline caustic solution including mercaptan compounds and oxidizing the mercaptan compounds in the second alkaline caustic solution to generate a third alkaline solution including a first concentration of disulfide compounds. The method further includes separating a portion of the disulfide compounds in the third alkaline solution to form a fourth alkaline solution including a second concentration of disulfide compounds. Still further, the method includes contacting the fourth alkaline solution with a second, relatively heavy hydrocarbon stream including mercaptan compounds to remove the mercaptan compounds from the second hydrocarbon stream, remove the disulfide compounds from the fourth alkaline solution, and generate the first alkaline caustic solution.

13 Claims, 2 Drawing Sheets

(56) References Cited

U.S. PATENT DOCUMENTS

| | | | |
|---|---|---|---|
| 4,626,341 | A | 12/1986 | Verachtert |
| 4,875,997 | A | 10/1989 | Langford |
| 6,565,740 | B2 | 5/2003 | Sain et al. |
| 2006/0188424 | A1 | 8/2006 | Kijlstra |
| 2012/0000827 | A1 | 1/2012 | Krupa et al. |

OTHER PUBLICATIONS

Maple, et al., "Removal of Sulfur From Light FCC Gasoline Stream," NPRA Annual Meeting Papers, v 2000, 27p, 2000, Conference: 2000 Annual Meeting—National Petrochemical and Refiners Association, Mar. 26, 2000-Mar. 28, 2000.

Search Report dated Jan. 15, 2015 for corresponding PCT Appl. No. PCT/US2014/059660.

METHODS FOR TREATING HYDROCARBON STREAMS CONTAINING MERCAPTAN COMPOUNDS

TECHNICAL FIELD

The present disclosure generally relates to methods for treating hydrocarbon streams. More particularly, the present disclosure relates to methods for treating hydrocarbon streams, such as naphtha streams and liquefied petroleum gas (LPG) streams, containing mercaptan (thiol) compounds.

BACKGROUND

Many distillate hydrocarbon streams produced from crude oil contain some amount of sulfur in one form or another unless they have been subjected to sulfur removal procedures, such as hydrotreating. Often, a major amount of this sulfur is present in the form of mercaptan (thiol) compounds. It is normally desirable to remove at least some portion of the mercaptan sulfur from the hydrocarbon distillate stream in order to meet certain product specifications, such as a limitation on the total sulfur content of a hydrocarbon product. It may also be desirable to remove mercaptan compounds from a hydrocarbon stream for the purpose of eliminating the rather malodorous mercaptan compounds and thereby improve or reduce the odor associated with the hydrocarbon stream. A further reason for removing mercaptan compounds from a hydrocarbon stream is to eliminate the passage of sulfur-containing compounds into a catalyst bed that is sensitive to the presence of sulfur. For example, it may be desirable to remove mercaptans from a hydrocarbon distillate stream, such as a butane or gasoline type stream or a petrochemical feed stream, for the purpose of preserving the activity of a catalyst employed in a downstream conversion unit.

Mercaptan compounds are commonly removed from hydrocarbon streams through the use of an extraction process in which the hydrocarbon stream is brought into contact with an aqueous alkaline solution. The hydrocarbon feed stream is passed through an extraction column countercurrent to a descending stream of aqueous alkaline solution normally referred to in the art as "caustic." The mercaptan compounds are preferentially dissolved in the aqueous alkaline "caustic" solution and are thereby extracted from the hydrocarbon stream. The mercaptan-containing caustic solution, which is referred to as a "rich" caustic solution, is then subjected to a procedure referred to as regeneration, which includes oxidizing the mercaptan compounds to disulfide (RSSR') compounds. An oxidation catalyst dissolved in the caustic solution promotes the oxidation of the extracted mercaptan compounds to disulfide compounds. The process then continues with separating the disulfide compounds from the aqueous solution by decantation (or other physical separation means) in a phase separation vessel. The resultant "lean" caustic is removed from the separation vessel and recycled to the extraction column.

It is known to the those skilled in the art that a good separation of the disulfide compounds from the caustic solution is required in order to minimize the content of disulfide compounds in the caustic being recirculated to the extraction column. The disulfide compounds are often soluble in hydrocarbon streams. Therefore, disulfide compounds present in the regenerated caustic being fed to the top of extraction column will become dissolved in the hydrocarbon stream that is being treated. This will raise the sulfur content of the treated hydrocarbon stream beyond an acceptable level. It is known in the art to counteract this effect by removing disulfide compounds from the regenerated caustic. The regenerated caustic may therefore be processed by contacting with a hydrocarbon stream, such as naphtha, pentane, or hexane, to remove or "wash" the disulfide compounds therefrom. The "washed" caustic solution is then passed into the extraction column. It is also known in the art to pass the washed hydrocarbon stream into the separation vessel from which the disulfide oil phase is removed rather than contacting the aqueous solution withdrawn from this vessel in a separate step. Washing the regenerated caustic, however, increases the cost of hydrocarbon processing systems in terms of capital (equipment) costs, material costs, and energy costs.

Accordingly, it is desirable to provide improved methods for treating hydrocarbon streams containing mercaptan compounds. Additionally, it is desirable to provide such methods that are able to remove disulfide compounds from the regenerated caustic without the need for separate washing apparatus/procedures. Furthermore, other desirable features and characteristics of the present disclosure will become apparent from the subsequent detailed description and the appended claims, taken in conjunction with the accompanying drawings and this background.

BRIEF SUMMARY

The present disclosure provides methods for treating hydrocarbon streams, such as naphtha streams and liquefied petroleum gas (LPG) streams, containing mercaptan (thiol) compounds. In one exemplary embodiment, disclosed is a method for treating hydrocarbon streams containing mercaptan compounds including contacting a first, relatively light hydrocarbon stream including mercaptan compounds with a first alkaline caustic solution to remove the mercaptan compounds from the first hydrocarbon stream and generate a second alkaline caustic solution including mercaptan compounds and oxidizing the mercaptan compounds in the second alkaline caustic solution to generate a third alkaline solution including a first concentration of disulfide compounds. The method further includes separating a portion of the disulfide compounds in the third alkaline solution to form a fourth alkaline solution including a second concentration of disulfide compounds. The first concentration of disulfide compounds is greater than the second concentration of disulfide compounds. Still further, the method includes contacting the fourth alkaline solution with a second, relatively heavy hydrocarbon stream including mercaptan compounds to remove the mercaptan compounds from the second hydrocarbon stream, remove the disulfide compounds from the fourth alkaline solution, and generate the first alkaline caustic solution.

In another exemplary embodiment, disclosed is a method for treating hydrocarbon streams containing mercaptan compounds including contacting a first, relatively light hydrocarbon stream including mercaptan compounds with a first alkaline caustic solution to remove the mercaptan compounds from the first hydrocarbon stream and generate a second alkaline caustic solution including mercaptan compounds, contacting a second, relatively light hydrocarbon stream including mercaptan compounds with a third alkaline caustic solution to remove the mercaptan compounds from the second hydrocarbon stream and generate a fourth alkaline caustic solution including mercaptan compounds, and combining the second and the fourth alkaline caustic solutions to form a fifth alkaline caustic solution including mercaptan compounds. The method further includes oxidizing the mercaptan compounds in the fifth alkaline caustic solution to generate a sixth alkaline solution including a first concentration of disulfide compounds and separating a portion of the disulfide compounds in the sixth alkaline solution to form a seventh alkaline caustic solution including a second concentration of disulfide compounds. The first concentration of disulfide compounds is greater than the second concentration of disulfide compounds. Still further, the method includes contacting the seventh alkaline solution with a third, relatively heavy hydrocarbon stream including mercaptan compounds to remove the mercaptan compounds from the third hydrocarbon stream, remove the disulfide compounds from the seventh alkaline caustic solution, and generate an eighth alkaline caustic solution and separating the eighth alkaline caustic solution into the first and second alkaline caustic solutions.

In yet another exemplary embodiment, disclosed is a method for treating hydrocarbon streams containing mercaptan compounds including contacting a first, relatively light hydrocarbon stream including mostly $C_3$ hydrocarbons mercaptan compounds with a first alkaline caustic solution including sodium hydroxide to remove the mercaptan compounds from the first hydrocarbon stream and generate a second alkaline caustic solution including mercaptan compounds, contacting a second, relatively light hydrocarbon stream including $C_4$ hydrocarbons and mercaptan compounds with a third alkaline caustic solution including sodium hydroxide to remove the mercaptan compounds from the second hydrocarbon stream and generate a fourth alkaline caustic solution including mercaptan compounds and combining the second and the fourth alkaline caustic solutions to from a fifth alkaline caustic solution including mercaptan compounds. The method further includes oxidizing the mercaptan compounds in the fifth alkaline caustic solution by contacting the fifth alkaline caustic solution with an oxidizing catalyst including a metal phthalocyanine derivate and oxygen to generate a sixth alkaline solution including a first concentration of disulfide compounds and separating a portion of the disulfide compounds in the sixth alkaline solution using a physical phase separation process to form a seventh alkaline caustic solution including a second concentration of disulfide compounds. The first concentration of disulfide compounds is greater than the second concentration of disulfide compounds. Still further, the method includes contacting the seventh alkaline solution with a third, relatively heavy hydrocarbon stream including naphtha hydrocarbons and mercaptan compounds to remove the mercaptan compounds from the third hydrocarbon stream, remove the disulfide compounds from the seventh alkaline caustic solution, and generate an eighth alkaline caustic solution, further contacting the third hydrocarbon stream with a dilute alkaline caustic solution to remove further mercaptan compounds from the third hydrocarbon stream, and separating the eighth alkaline caustic solution into the first and second alkaline caustic solutions. The method excludes contacting the seventh alkaline caustic solution with a wash hydrocarbon stream.

BRIEF DESCRIPTION OF THE DRAWINGS

The present embodiments will hereinafter be described in conjunction with the following drawing Figures, wherein like numerals denote like elements, and wherein.

DETAILED DESCRIPTION

Figure 1:
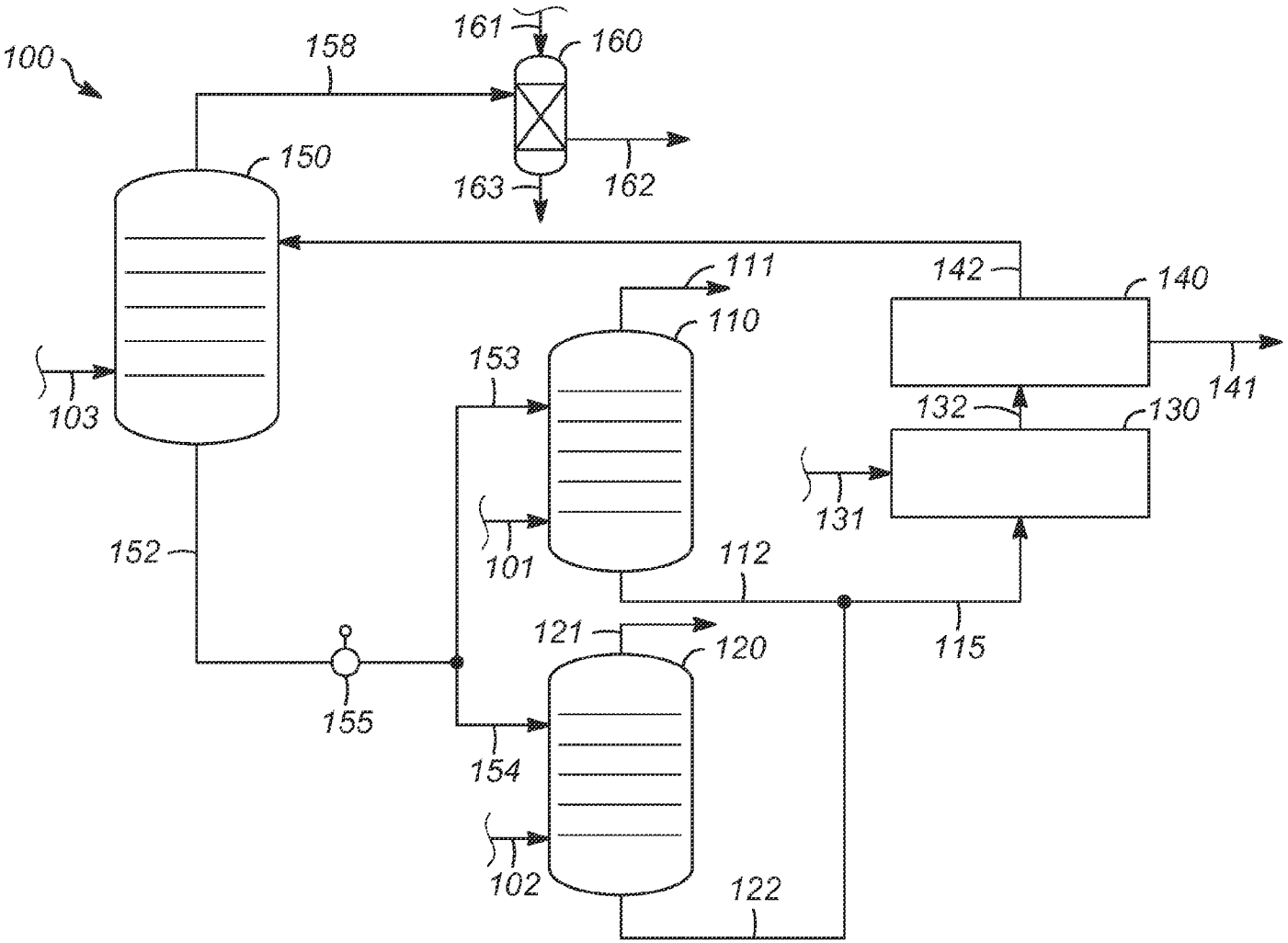
FIG. 1 is a process flow diagram illustrating a method implemented on a hydrocarbon treatment system in accordance with various embodiments of the present disclosure.

The following detailed description is merely exemplary in nature and is not intended to limit the application and uses of the embodiments described. Furthermore, there is no intention to be bound by any theory presented in the preceding background or the following detailed description.

The various embodiments described herein relate to methods for treating hydrocarbon streams, such as naphtha streams and liquefied petroleum gas (LPG) streams, containing mercaptan (thiol) compounds. Exemplary embodiments treat both a relatively heavy hydrocarbon feed stream, such as a naphtha feed stream, wherein the presence of disulfide compounds therein is not undesirable, and a relatively light hydrocarbon feed stream, such as a $C_3$ and/or $C_4$ (wherein the terminology $C_n$ refers to a hydrocarbon compound having "n" carbon atoms) hydrocarbon feed stream, wherein the presence of disulfide compounds therein is undesirable, using the same alkaline caustic solution. The caustic solution is used to treat (i.e., remove mercaptan compounds from) the $C_3$ and/or $C_4$ hydrocarbon feed stream, is regenerated using conventional regeneration processes (i.e., oxidation of the mercaptan compounds to disulfide compounds using a catalyst and removal of most of the disulfide compounds using physical separation), and then is used to treat the naphtha feed stream. During treatment of the naphtha feed stream, the remaining disulfide compounds are removed from the regenerated caustic solution and dissolve into the naphtha feed stream, while the mercaptan compounds are extracted from the naphtha feed stream into the caustic solution. The caustic solution, with extracted mercaptans therein, is then used to treat the $C_3$ and/or $C_4$ hydrocarbon feed stream, thus providing a closed-loop caustic treatment system. The use of the naphtha feed stream to remove disulfide compounds from the regenerated caustic solution removes the need for separate washing apparatus/procedures, and also reduces the required size of the physical separation system for disulfide removal. As such, overall capital, material, and energy costs are reduced as compared to prior art systems/methods.

In accordance with some embodiments, the above-noted relatively light hydrocarbon feed streams suitable for treatment by the disclosed systems and methods are, for example, hydrocarbon streams containing mercaptan compounds that are highly-soluble in common alkaline streams, such as an aqueous solution of sodium hydroxide. For example, hydrocarbon streams containing $C_3$, $C_4$, or a combination of $C_3$ and $C_4$ hydrocarbons are exemplary, lower boiling hydrocarbon streams that may be treated by the described embodiments. In general, the mercaptan compounds contained in these hydrocarbon streams are soluble in common alkaline streams, and are present in an amount of about 50 to about 10,000 weight parts per million (wt. ppm) of the stream, calculated as sulfur. (In contrast, hydrocarbon streams boiling in the range of $C_5$ and higher often contain mercaptan compounds that are not completely soluble in common alkaline streams, and as such, these latter streams may not be suitable for use herein as the light hydrocarbon feed stream.)

The above-noted relatively heavy hydrocarbon feed streams suitable for treatment by the disclosed systems and methods are, for example, hydrocarbon streams that are capable of dissolving disulfide compounds. In general, any hydrocarbon stream boiling in the $C_5$ and higher range is suitable, including for example gasoline fractions, such as cracked gasoline, straight-run gasoline, natural gasoline, or mixtures thereof, and naphthas. In an exemplary embodiment, the relatively heavy hydrocarbon feed stream includes a naphtha stream due to the fact that the presence of disulfide compounds therein is often tolerated or even desirable. Is some embodiments, this hydrocarbon stream may contain about 100 to about 50,000 wt. ppm of mercaptan sulfur, calculated on a sulfur basis.

The above-noted alkaline caustic solution utilized in some embodiments may include any alkaline reagent known to have the capability to extract mercaptan compounds from the relatively light hydrocarbon streams. In one embodiment, the alkaline caustic solution may include an aqueous solution of an alkali metal hydroxide, such as sodium hydroxide or potassium hydroxide. Similarly, aqueous solutions of alkaline earth hydroxides may also be utilized. In a particular embodiment, the alkaline caustic solution for use in the present disclosure is an aqueous solution of about 1 to about 50 percent by weight (wt. %) of sodium hydroxide, such as an aqueous solution of about 4 to about 25 wt % sodium hydroxide. Chemical agents that increase of solubility of mercaptan compounds, such as alcohols, alkylphenols, or diakylsulfoxides, may optionally be added to the alkaline solution.

The above-noted alkaline caustic solution regeneration catalyst utilized in accordance with some embodiment of the present disclosure may be any catalyst that is effective to accelerate the oxidation of mercaptan compounds or mercaptides (metallic salts of mercaptan compounds) to disulfide compounds. In one embodiment, the regeneration catalyst may include a metal phthalocyanine derivate. Metal phthalocyanines include, for example, cobalt phthalocyanine, vanadium phthalocyanine, iron phthalocyanine, copper phthalocyanine, nickel phthalcyanine, and chromium phthalocyanine. The metal phthalocyanine per se may not be sufficiently active for the oxidation of mercaptan compounds and, accordingly, it is often desirable to utilize a polar derivative thereof. In some embodiments, polar derivatives of metal phthalocyanines may include sulfonated derivatives such as the mono-sulfo derivatives, the di-sulfo derivatives, the tri-sulfo derivatives, and the tetra-sulfo derivatives. These derivatives may be obtained from any suitable source or may be prepared by one of two general methods: first, the metallic phthalocyanine compound may be reacted with a fuming sulfuric acid; or second, the phthalocyanine compound may be synthesized from a sulfo-substituted phthalic anhydride or equivalent thereof.

Phthalocyanine mercaptan oxidation catalysts in accordance with the present disclosure may be used in one of two modes. First, it maybe utilized in a water soluble form or a form that is capable of forming a stable emulsion in water. Second, the phthalocyanine catalyst may be utilized as a combination of a phthalocyanine compound with a suitable carrier material. In the first mode (homogeneous mode), the catalyst is present as a dissolved or suspended solid in the alkaline caustic stream, which is charged to the regeneration vessel. In this mode, a catalyst such as cobalt or vanadium phthalocyanine disulfonate may be utilized in an amount of about 5 to about 1,000 wt. ppm of the alkaline caustic solution. In the second mode of operation (heterogeneous mode), a catalyst such as a fixed bed of particles of a composite of the phthalocyanine compound with a suitable carrier material may be utilized. The carrier material may be insoluble or substantially unaffected by the alkaline stream or hydrocarbon stream under the conditions prevailing in the various steps of the process. Activated charcoals are suitable for use as the carrier material because of their high adsorptivity under these conditions. The amount of the phthalocyanine compound combined with the carrier material may be from about 0.1 to about 2.0 wt % of the final composite.

Reference is now made to FIG. 1, which is a process flow diagram illustrating a method implemented on a hydrocarbon treatment system 100 in accordance with various embodiments of the present disclosure. As shown, in this embodiment, two relatively light hydrocarbon feed streams are provided. A first, relatively light hydrocarbon feed stream 101 including mostly (as used herein, the term "mostly" is used to refer to a stream that contains greater than about 80%, greater than about 90%, or greater than about 95% of the identified compound) $C_3$ hydrocarbons is passed to a first liquid/liquid extraction column 110. The $C_3$ hydrocarbons stream may include $C_3$ paraffins, $C_3$ olefins, and/or $C_3$ acetylene hydrocarbons in any combination. The $C_3$ hydrocarbons stream may be mostly free of $H_2S$ (for example, less than about 5 wt. ppm, such as less than about 1 wt. ppm). The first hydrocarbon stream 101 passes upward through liquid/liquid extraction trays a column 110 rising countercurrent to a descending stream 153 of an aqueous alkaline caustic solution. During passage upward through the liquid/liquid extraction column 110, mercaptan compounds originally present in the first light hydrocarbon feed stream 101 transfer into the descending caustic solution, which results in removal of the mercaptan compounds to a lower level and the production of a first treated stream 111, which is removed from system 100. The caustic stream 153 is fed at or near the top of the extraction column 110 and the rich or mercaptan-containing caustic is removed from the bottom of a column 110 through line 112.

As further shown in FIG. 1, a second, relatively light hydrocarbon feed stream 102 including mostly $C_4$ hydrocarbons is passed to a second liquid/liquid extraction column 120. The $C_4$ hydrocarbons stream may include $C_4$ paraffins, $C_4$ olefins, and/or $C_4$ acetylene hydrocarbons in any combination. The $C_4$ hydrocarbons stream may be mostly free of $H_2S$ (for example, less than about 5 wt. ppm, such as less than about 1 wt. ppm). The second hydrocarbon stream 102 passes upward through liquid/liquid extraction trays of column 120 rising countercurrent to a descending stream 154 of an aqueous alkaline caustic solution.

During passage upward through the liquid/liquid extraction column 120, mercaptan compounds originally present in the second light hydrocarbon feed stream 102 transfer into the descending caustic solution, which results in removal of the mercaptan compounds to a lower level and the production of a second treated stream 121, which is removed from system 100. The caustic stream 154 is fed near the top of the extraction column 120 and the rich or mercaptan-containing caustic is removed from the bottom of a column 120 through line 122.

Regarding either of liquid/liquid extraction columns 110 or 120, as noted above, the subject extraction processes may utilize any alkaline reagent that is capable of extracting mercaptan compounds from the respective first and second light hydrocarbon feed streams at practical operating conditions and may be regenerated in the manner described. An exemplary alkaline reagent includes an aqueous solution of an alkaline metal hydroxide, such as sodium hydroxide or potassium hydroxide. Sodium hydroxide may be used in concentrations of from about 1 to about 50 wt. %, for example from about 5 to about 25 wt. %. The conditions employed in the first and second extraction columns 110, 120 may vary greatly depending on such factors as the nature of the hydrocarbon stream being treated and its mercaptan content. In general, the mercaptan extraction may be performed at an ambient temperature above about 15° C. and at a pressure sufficient to ensure liquid state operation. Such pressures may range from about standard atmospheric pressure up to about 7000 $kPa_g$ (about 1000 $psi_g$) or more, for example from about 1000 to about 2400 $kPa_g$ (about 150 to about 350 $psi_g$). More generally, the temperature in the liquid/liquid extraction columns 110, 120 may be from about 10 to about 120° C. (about 50 to about 250° F.), for example from about 25 to about 50° C. (about 80 to about 120° F.). The ratio of the volume of the alkaline solution provided per volume of the feed streams 101, 102 will vary depending on the mercaptan content of the respective feed stream. In general, this ratio may be from about 0.01:1 to about 1:1, although other ratios may be used. The rate of flow of the alkaline solution may be from about 1 to about 5% of the rate of flow of the respective light hydrocarbon stream 101, 102.

The configuration of the extraction zones within the columns 110, 120 may be a vertically trayed column having a large number of circular perforations. Suitable extraction in this liquid/liquid system is obtained with a velocity through the perforations of from about 5 to about 10 feet per second. A packed column and other types of extraction equipment could be employed, in alternative embodiments. In one particular example, one or both of the first and second liquid/liquid extraction columns may be a "fiber-film" contacting system, as known in the art. As a result of the extraction process, essentially all of the extractable mercaptan compounds in both the first and second light hydrocarbon streams 101, 102 should be transferred to the alkaline caustic solution. As used herein, the term "essentially all" is intended to refer to at least 85%, for example at least 95%, of all the material referred to.

Upon exiting respective columns 110, 120, the mercaptan-containing or "rich" alkaline caustic solutions contained in lines 112 and 122 are combined into a single stream 115, which is passed to an oxidation unit 130. Within the oxidation unit 130, the stream 115 is mixed with an air stream 131 supplied at a rate that supplies at least the stoichiometric amount of oxygen necessary to oxidize the mercaptan compounds in the alkaline stream 115. The air or other oxidizing agent is admixed with the liquid alkaline stream and the mixed-phase admixture is then passed into an oxidation zone of the oxidation unit 130. The oxidation of the mercaptan compounds is promoted, as noted above, through the presence of a catalytically effective amount of an oxidation catalyst capable of functioning at the conditions found in the oxidizing zone. Several suitable materials are known in the art. An exemplary oxidation catalyst, as noted above, is a metal phthalocyanine derivative such as a cobalt phthalocyanine or a vanadium phthalocyanine derivate. Higher catalytic activity may be obtained through the use of a polar derivative of the metal phthalocyanine, for example the mono-sulfo, di-sulfo, tri-sulfo, and tetra-sulfo derivatives thereof.

The oxidation conditions utilized in oxidation unit 130 may include a pressure from about standard atmospheric pressure to about 7000 $kPa_g$ (about 1000 $psi_g$). In various embodiment, the pressure may be less than about 500 $kPa_g$ (about 70 $psi_g$). The temperature in the oxidation unit 130 may be from about 15° C. to about 95° C. (about 200° F.) when operating near atmospheric pressure and to about 200° C. (about 400° F.) when operating at superatmospheric pressures. In some embodiments, the temperature may be from about 40° C. to about 80° C. The oxidation unit 130 may be configured in a packed bed configuration to ensure adequate mixing between the caustic solution, the catalyst, and the oxygen.

The oxidized alkaline caustic solution is thereafter passed via stream 132 to a phase separation unit 140 configured to separate disulfide compounds from the alkaline caustic solution. The phase separation unit 140 may be of any suitable configuration, for example including a settler or other physical phase separation apparatus. In some embodiments, the phase separation unit 140 is operated at a minimum pressure for which other design considerations will allow. This method of operation is useful to promote the transfer of the excess oxygen, nitrogen, and water into the vapor phase. For example, the pressure in the phase separation unit 140 may be from about standard atmospheric pressure to about 2000 $kPa_g$ (about 300 $psi_g$) or more. In an exemplary embodiment, the pressure may be from about 65 to about 300 $kPa_g$. The temperature in the phase separation unit 140 may be from about 10 to about 120° C. (about 50 to about 250° F.), for example from about 25 to about 55° C. The phase separation unit 140 may be sized to allow the relatively denser alkaline caustic solution to separate by gravity from the disulfide compounds. This separation may be aided by a coalescing means located in the unit 140, as is known in the art. Separated disulfide compounds exit unit 140, and system 100, via stream 141. Spent air also leaves the phase separation unit 140 through a non-illustrated stream.

As previously noted, the phase separation unit 140 may not be capable of removing a desired amount of the disulfide compounds in the alkaline caustic solution (from stream 132). (That is, less than about 200 wt. ppm may be desirable.) In prior art systems, the alkaline caustic solution would be passed to a washing apparatus, as described above, to accomplish further removal of disulfide compounds. The presently described embodiments, however, do not employ the use of a washing apparatus, but instead pass the alkaline caustic solution from the phase separation unit 140 directly to a third liquid/liquid extraction column 150 via a stream 142, as will be described in greater detail below.

As explained hereinbefore, embodiments of the present disclosure are configured to treat both a relatively heavy hydrocarbon feed stream, such as a naphtha feed stream, wherein the presence of disulfide compounds therein is not undesirable, and a relatively light hydrocarbon feed stream, such as a $C_3$ and/or $C_4$ hydrocarbon feed stream, wherein the presence of disulfide compounds therein is undesirable, using the same alkaline caustic solution. In this regard, a relatively heavy hydrocarbon feed stream 103 may be provided to the third liquid/liquid extraction column 150. The stream 103 may be any relatively high boiling hydrocarbon stream such as a gasoline fraction. An exemplary relatively heavy hydrocarbon stream 103 is a straight-run naphtha having a boiling range of about 80 to about 200° C. (about 175 to about 400° F.) and a mercaptan compound sulfur content of about 100 wt. ppm or greater. Also charged to the extraction column 150 is the alkaline caustic solution stream 142 from the separation unit 140. This stream 142 contains, for example, about the same (i.e., +/− about 10%) wt % sodium hydroxide as the alkaline caustic solution streams 153, 154 described above. Column 150 is configured for achieving contact between the ascending heavy hydrocarbon stream 103 and the descending alkaline stream 142. In some embodiments, column 150 may be operated at about the same temperature and pressure conditions as described above with regard to columns 110 and 120. In general, for a higher boiling hydrocarbon stream such as a naphtha stream, a slightly higher volume ratio of alkaline stream to hydrocarbon stream may be employed (relative to columns 110 and 120). For example, for a straight-run naphtha, given as an example here, suitable results are obtained with about a 20% volume ratio.

Because the mercaptan compounds contained in the higher boiling hydrocarbon stream are not completely soluble in the alkaline stream, a treated hydrocarbon stream 158 withdrawn from the top of column 150 may generally contain about 10 to about 100 ppm of residual mercaptan compound sulfur. Accordingly, in some embodiments, it may be desirable to give this "partially-treated" stream 158 a further treatment for the removal of mercaptan compounds, and the partially-treated hydrocarbon stream 158 withdrawn from column 150 may thus be passed to further oxidation unit 160. In one embodiment, in further oxidation unit 160, a stream 161 of a dilute caustic solution is continuously injected into the unit, along with the addition of air or another oxygen source. Streams 158 and 161 are then combined in further oxidation unit 160, and the combined stream passes through a fixed-bed of an oxidation catalyst where the remaining mercaptan compounds are oxidized to disulfides, and the dilute caustic solution is coalesced. The resulting heavy hydrocarbon product stream 162 is substantially free of entrained caustic and requires no further filtration or separation. Coalesced spent caustic is collected in a small drain pot via line 163 and is removed from system 100. A suitable further oxidation unit 160 that may be used in some embodiments of the present disclosure is the Minalk™ system available from UOP LLC of Des Plaines, Ill., USA.

Referring back to liquid/liquid extraction column 150, a mercaptan-containing caustic (substantially free of disulfide compounds, for example, containing less than about 10 wt. ppm disulfide compounds, such as less than about 5 wt. ppm, or less than about 2 wt. ppm) is removed from the bottom of column 150 through line 152. Line 152 is thereafter transferred downstream using a pump 155, whereafter it is split into the above-noted aqueous alkaline caustic solutions streams 153 and 154. As such, the caustic solution employed in the presently described embodiments operates in a "closed-loop" system.

Figure 2:
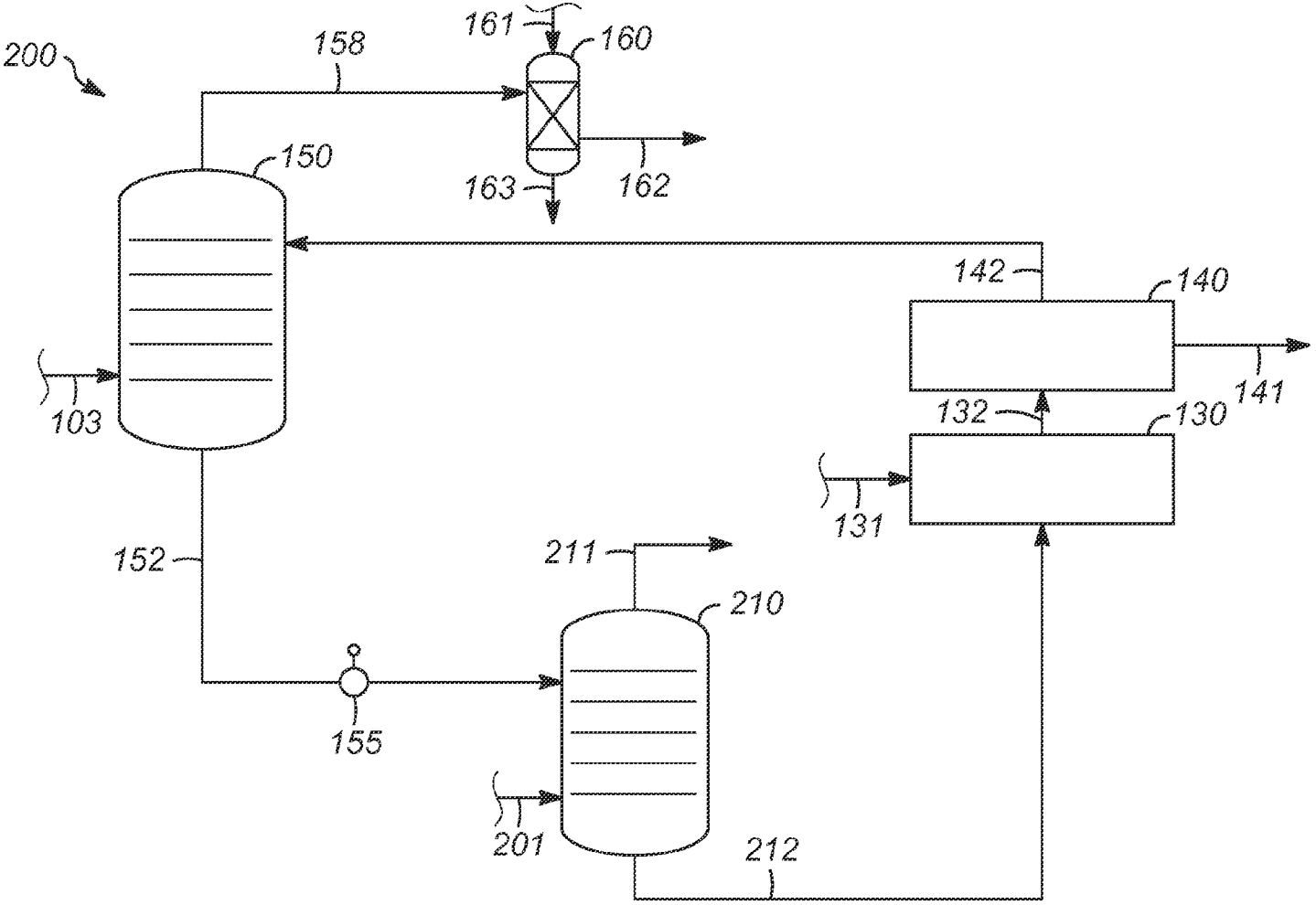
FIG. 2 is a process flow diagram illustrating a method implemented on a hydrocarbon treatment system in accordance with further embodiments of the present disclosure.

An alternate embodiment of the present disclosure (system 200) is provided in connection with FIG. 2. As shown therein, as opposed to being split into two streams 153 and 154, the caustic solution stream 152 from column 150 is directed to a single liquid/liquid extraction column 210. A single, relatively light hydrocarbon feed stream 201 including mostly $C_3$, $C_4$, or a combination of $C_3$ and $C_4$ hydrocarbons is passed to the single liquid/liquid extraction column 210. The relatively light hydrocarbons stream 201 may include $C_3$/C4 paraffins, $C_3/C_4$ olefins, and/or $C_3/C_4$ acetylene hydrocarbons in any combination. The hydrocarbon stream 201 passes upward through the liquid/liquid extraction trays of column 210 rising countercurrent to the descending stream 152 of the aqueous alkaline caustic solution from column 150. During passage upward through the liquid/liquid extraction column 210, mercaptan compounds originally present in the single light hydrocarbon feed stream 201 transfer into the descending caustic solution, which results in removal of the mercaptan compounds to a lower level and the production of a single treated stream 211, which is removed from system 200. The caustic stream 152 is fed near the top of the extraction column 120 and the rich or mercaptan-containing caustic is removed from the bottom of a column 210 through line 212. Line 212 is thereafter passed to oxidation unit 130, and the operation of system 200 continues substantially as described above with regard to the operation of system 100. In various other embodiments, more than two (as in system 100) light hydrocarbon liquid/liquid extraction columns may be provided. In still further embodiments, a gas/liquid extraction could alternatively or additionally be supplied in the event it is desirable to treat a gaseous-phase hydrocarbon stream.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the application in any way. Rather, the foregoing detailed description will provide those skilled in the art with a convenient road map for implementing one or more embodiments, it being understood that various changes may be made in the function and arrangement of elements described in an exemplary embodiment without departing from the scope, as set forth in the appended claims.

What is claimed is:

1. A method for treating hydrocarbon streams containing mercaptan compounds comprising the steps of:

contacting a first, light hydrocarbon stream comprising mercaptan compounds with a first alkaline caustic solution to remove the mercaptan compounds from the first hydrocarbon stream and generate a second alkaline caustic solution comprising mercaptan compounds; wherein the light hydrocarbon stream comprises greater than about 80 mass-% $C_3$ hydrocarbons, or greater than about 80 mass-% $C_4$ hydrocarbons, or greater than about 80 mass-% $C_3$ and $C_4$ hydrocarbons;

oxidizing the mercaptan compounds in the second alkaline caustic solution to generate a third alkaline solution comprising a first concentration of disulfide compounds;

separating a portion of the disulfide compounds in the third alkaline solution to form a fourth alkaline caustic solution comprising a second concentration of disulfide compounds, wherein the first concentration of disulfide compounds is greater than the second concentration of disulfide compounds; and contacting the fourth alkaline solution with a second, heavy hydrocarbon stream comprising greater than about 80 mass-% naphtha compounds and further comprising mercaptan compounds to remove the mercaptan compounds from the second hydrocarbon stream, remove the disulfide compounds from the fourth alkaline caustic solution, and generate the first alkaline caustic solution.

2. The method of claim 1, wherein contacting with the first alkaline solution comprises contacting with a solution comprising a sodium hydroxide solution.

3. The method of claim 1, wherein oxidizing the mercaptan compounds comprises contacting the mercaptan compounds with an oxidizing catalyst and oxygen.

4. The method of claim 1, wherein the separating the portion of the disulfide compounds in the third alkaline solution to form a fourth alkaline caustic solution comprising a second concentration of disulfide compounds, comprises a physical phase separation process.

5. The method of claim 1, wherein generating the third alkaline solution comprises generating an alkaline solution comprising a disulfide concentration of about 200 wt. ppm or less.

6. The method of claim 1, wherein generating the fourth alkaline solution comprises generating an alkaline solution comprising a disulfide concentration of less than about 5 wt. ppm.

7. A method for treating hydrocarbon streams containing mercaptan compounds comprising the steps of:

contacting a first, light hydrocarbon stream comprising mercaptan compounds with a first alkaline caustic solution to remove the mercaptan compounds from the first hydrocarbon stream and generate a second alkaline caustic solution comprising mercaptan compounds; wherein the light hydrocarbon stream comprises greater than about 80 mass-% $C_3$ hydrocarbons, or greater than about 80 mass-% $C_4$ hydrocarbons;

contacting a second, light hydrocarbon stream comprising greater than about 80 mass-% $C_4$ hydrocarbons and further comprising mercaptan compounds with a third alkaline caustic solution to remove the mercaptan compounds from the second hydrocarbon stream and generate a fourth alkaline caustic solution comprising mercaptan compounds;

combining the second and the fourth alkaline caustic solutions to form a fifth alkaline caustic solution comprising mercaptan compounds;

oxidizing the mercaptan compounds in the fifth alkaline caustic solution to generate a sixth alkaline solution comprising a first concentration of disulfide compounds;

separating a portion of the disulfide compounds in the sixth alkaline solution to form a seventh alkaline caustic solution comprising a second concentration of disulfide compounds, wherein the first concentration of disulfide compounds is greater than the second concentration of disulfide compounds;

contacting the seventh alkaline solution with a third, heavy hydrocarbon stream comprising greater than about 80 mass-% naphtha compounds and further comprising mercaptan compounds to remove the mercaptan compounds from the third hydrocarbon stream, remove the disulfide compounds from the seventh alkaline caustic solution, and generate an eighth alkaline caustic solution; and separating the eighth alkaline caustic solution into the first alkaline caustic solution and an additional portion of the second alkaline caustic solution.

8. The method of claim 7, wherein contacting with the first alkaline solution comprises contacting with a solution comprising a sodium hydroxide solution.

9. The method of claim 7, wherein oxidizing the mercaptan compounds comprises contacting the mercaptan compounds with an oxidizing catalyst and oxygen.

10. The method of claim 7, wherein separating the portion of the disulfide compounds in the sixth alkaline solution to form a seventh alkaline caustic solution comprises a physical phase separation process.

11. The method of claim 7, wherein generating the sixth alkaline solution comprises generating an alkaline solution comprising a disulfide concentration of about 200 wt. ppm or less.

12. The method of claim 7, wherein generating the seventh alkaline solution comprises generating an alkaline solution comprising a disulfide concentration of less than about 5 wt. ppm.

13. A method for treating hydrocarbon streams containing mercaptan compounds comprising the steps of:

contacting a first, light hydrocarbon stream comprising greater than about 80 mass-% $C_3$ hydrocarbons mercaptan compounds with a first alkaline caustic solution comprising sodium hydroxide to remove the mercaptan compounds from the first hydrocarbon stream and generate a second alkaline caustic solution comprising mercaptan compounds;

contacting a second, light hydrocarbon stream comprising $C_4$ hydrocarbons and mercaptan compounds with a third alkaline caustic solution comprising sodium hydroxide to remove the mercaptan compounds from the second hydrocarbon stream and generate a fourth alkaline caustic solution comprising mercaptan compounds;

combining the second and the fourth alkaline caustic solutions to from a fifth alkaline caustic solution comprising mercaptan compounds;

oxidizing the mercaptan compounds in the fifth alkaline caustic solution by contacting the fifth alkaline caustic solution with an oxidizing catalyst comprising a metal phthalocyanine derivate and oxygen to generate a sixth alkaline solution comprising a first concentration of disulfide compounds;

separating a portion of the disulfide compounds in the sixth alkaline solution using a physical phase separation process to form a seventh alkaline caustic solution comprising a second concentration of disulfide compounds, wherein the first concentration of disulfide compounds is greater than the second concentration of disulfide compounds;

contacting the seventh alkaline solution with a third, heavy hydrocarbon stream comprising naphtha hydrocarbons and mercaptan compounds to remove the mercaptan compounds from the third hydrocarbon stream, remove the disulfide compounds from the seventh alkaline caustic solution, and generate an eighth alkaline caustic solution;

further contacting the third hydrocarbon stream with a dilute alkaline caustic solution to remove further mercaptan compounds from the third hydrocarbon stream; and separating the eighth alkaline caustic solution into the first alkaline caustic solution and an additional portion of the second alkaline caustic solution.

* * * * *